United States Patent [19]

Zedrosser

[11] Patent Number: 4,739,570

[45] Date of Patent: Apr. 26, 1988

[54] FIREARM

[75] Inventor: Ulrich Zedrosser, Steyr, Austria

[73] Assignee: Steyr-Daimler-Puch AG, Vienna, Austria

[21] Appl. No.: 68,962

[22] Filed: Jul. 1, 1987

[30] Foreign Application Priority Data

Jul. 8, 1986 [AT] Austria ..... 1844/86

[51] Int. Cl.[4] ..... F41C 11/00; F41C 19/00

[52] U.S. Cl. ..... 42/15; 42/39.5; 42/69.01

[58] Field of Search ..... 42/2, 14, 15, 26, 27, 42/39.5, 69.01; 89/155, 156, 9, 33.03

[56] References Cited

U.S. PATENT DOCUMENTS

| | | | |
|---|---|---|---|
| 38,604 | 5/1863 | Rice | 42/39.5 |
| 658,010 | 9/1900 | Hoffman | 42/15 |
| 3,483,648 | 12/1969 | Speckhart | 42/15 X |
| 3,667,147 | 6/1972 | Goldin et al. | 42/15 |
| 4,035,943 | 7/1977 | Civolani et al. | 42/16 X |

FOREIGN PATENT DOCUMENTS

| | | |
|---|---|---|
| 26115 | 10/1906 | Austria . |
| 1056631 | 6/1979 | Canada . |
| 2401543 | 8/1976 | Fed. Rep. of Germany . |
| 2413615 | 4/1979 | Fed. Rep. of Germany . |
| 317851 | 1/1902 | France . |
| 347965 | 3/1905 | France . |

*Primary Examiner*—Ted L. Parr

*Attorney, Agent, or Firm*—Marmorek, Guttman & Rubenstein

[57] ABSTRACT

A firearm (1) comprises a housing (2), a barrel (3), means defining a chamber (5), and a firing mechanism including a trigger (10). The chamber (5) is defined by a chamber member (4), which is separate from the barrel (3) and is mounted in the housing (2) for reciprocation between a firing position and a loading position transversely to the axis of the barrel. In the firing position, a forward end of the chamber (5) coaxially adjoins and is open to the barrel bore and the rear end of the chamber (5) is closed by a closing wall (7) of the housing (2). In the loading position, both ends of the chamber (5) are exposed on the outside of the housing and spaced from the barrel and the closing wall. A firearm having a structure which is simple, rugged and reliable in operation is provided in that the chamber member (4) constitutes a part of the firing mechanism and the kinetic energy of the chamber member arriving in its firing position is utilized to fire the cartridge contained in the chamber by an action on the primer of said cartridge.

6 Claims, 3 Drawing Sheets

FIREARM

BACKGROUND OF THE INVENTION

1. Field of the Invention

This invention relates to a firearm comprising a housing, a barrel, a chamber structure and a firing mechanism including a trigger, wherein the chamber structure is constituted by a chamber member, which is separate from the barrel and is slidably guided in the housing transversely to the barrel axis for reciprocation between a firing position and a loading position, when the chamber member is in its firing position the chamber at one end thereof coaxially adjoins the barrel and at the other end is closed by a closing wall of the housing, and when the chamber member is in its loading position both ends of the chamber are spaced from the barrel and the closing wall.

2. Description of the Prior Art

In most known firearms the barrel defines also a chamber for receiving the projectile or cartridge and a breechblock is longitudinally guided in the housing to seal the chamber on the rear so that the projectile can be propelled forwardly through the barrel. But such firearms have complicated breech-closing and firing mechanisms, which are composed of a large number of members, which can be manufactured only at high cost and result in a considerable overall length of the firearm and are liable to be deranged even when they are made and assembled with high precision.

AT-A-26,115, FR-A-317,851 and US-A-658,010 disclose firearms which have separate chamber members, which define a chamber and are reciprocable between a firing position for the discharge of a round and a loading position for receiving a cartridge. The chamber may be open only at one end for a firing of a caseless cartridge or may be open at both ends for a firing of a cartridge having a case. Said chamber members must be actuated by a springbiased rocker mechanism, which is incorporated in the firing mechanism, and the trigger can be operated at the same time to cock and actuate a firing pin of the firing mechanism so that the mechanism is also rather complicated and unreliable and the firearm cannot be used at all for military purposes.

DE-B-24 01 543 and DE-C-24 13 615 disclose a drum-shaped chamber member, which is rotatably mounted in the housing and is rotated through an angle of 90 degrees to move the chamber from its loading position to its firing position. Such rotary drums have not proved satisfactory in practice because they require the provision of expensive actuating, controlling and firing mechanisms and give rise to great difficulties when the cartridge case must be ejected because they must be moved to a special ejecting position for that purpose or the cartridge case that remained in the chamber or a cartridge that has not been fired must be pushed back from the chamber into the magazine.

In other known firearms the magazine defines also a chamber in which the cartridge is fired. Such firearms may have a rotatable drum magazine, e.g., in a revolver, or as disclosed in CA-A-1,056,631 and FR-A-347,965 may have a transversely displaceable bar magazine, which can repeatedly be advanced in the same direction to move consecutive cartridges to a firing position, in which the cartridge is axially aligned with the barrel and can be fired by a centering mechanism. In such firearms the chamber member is not a part of the firearm proper so that it is difficult to seal the chamber and, because the magazines may easily be damaged, the firearms are often jammed and liable to other functional disturbances.

The ammunition for use with the known firearms described hereinbefore must consist of caseless cartridges in those firearms from which cartridge cases cannot be ejected or can be ejected only with difficulty, although said caseless cartridges have not proved satisfactory, or the ammunition must consist of metal-cased cartridges in those firearms in which the chamber is only poorly sealed. The advantageous cartridges having plastic cases cannot be used in any of said known firearms.

SUMMARY OF THE INVENTION

It is an object of the invention to provide a firearm which is of the kind described first hereinbefore and distinguishes by having a structure which is simple but reliable in operation and consists of a relatively small number of parts, which can easily be manufactured. Besides, the firearm should require only a relatively short overall length and should excellently be adapted to fire plastic-cased cartridges.

That object is accomplished in accordance with the invention in that the chamber member constitutes a part of the firing mechanism and the kinetic energy of the chamber member as it arrives in the firing position is utilized to fire the cartridge. Because the chamber member is incorporated in the firing mechanism and its kinetic energy is utilized to fire the cartridge, the need for a separate striking mechanism for exerting a firing force is eliminated so that the space requirement and the structural expenditure are reduced and the overall length can also be reduced. There is no need for complicated lever mechanisms and the members which are used are simple and rugged and constitute a loading and firing mechanism that is efficient and unlikely to be deranged and can be used to fire ammunition of any desired kind, inclusive of plastic-cased cartridges.

The firearm may be provided with a firing mechanism of any desired kind. If a firing mechanism is used which comprises a firing pin, which when the chamber member is in its firing position enters the chamber defined by said chamber member, such firing pin may be movably mounted in the housing or in the chamber member and may be actuated by the chamber member striking directly on the firing pin or via a linkage. In a particularly desirable design within the scope of the invention the firing means comprise a firing pin which is fixed to the housing and extends transversely to the barrel axis, and a firing bore, which is formed in the chamber member and associated with the firing pin and leads radially into the chamber. In that case the firing means may consist only of a simple and strong firing pin, which is fixed to the housing and which moves in the firing bore of the arriving chamber member to enter the chamber and to strike on the rim primer of an appropriate cartridge. In that case the chamber member arriving in its firing position will not release a striker for striking on the firing pin but virtually constitutes a striker for exerting a firing force. That feature provides a simple, efficient and functionally reliable system for firing cartridges having suitable rim primers.

A particularly desirable embodiment of the invention relates to a firearm in which the chamber member is adapted to be releasably locked in its loading position by the spring-loaded trigger and a spring drive is provided for moving the chamber member from its loading position to its firing position. In that embodiment a slider is provided, which is movable rearwardly against the force of a restoring spring by means of a gas-operable actuator that comprises a piston-cylinder unit, which is operable by powder gases, and said slider has cam faces which are oblique to the direction in which the slider is displaceable and during said rearward movement cooperate with cam followers, which are provided on the chamber member so as to return the latter from its firing position to its loading position. The combination of the spring drive and the gas-operated actuator results in a reliable sequence of operations for loading and firing the firearm and for ejecting the cartridge case and the firearm has a rugged structure that is not likely to be deranged. Besides the firing sequence can be automated.

To ensure that the loading and ejecting operations will be performed quickly and in a reliable manner, it is a feature of the invention that the slider carries a telescopic ejector rod, which is parallel to the barrel and protrudes freely toward the chamber member and can be axially compressed against the force of an ejector spring. That ejector rod is coaxial to the chamber of the chamber member when the latter is in its loading position, and the ejector rod is adapted to be moved into the loading chamber by the rearwardly moving slider when the chamber member is in its loading position. When a round has been discharged, the rearwardly moving slider will return the chamber member to its loading position and will move the ejector rod into the chamber so that the ejector rod will reliably eject the cartridge case that is contained in the chamber. Because an extractor claw is not provided, that ejection will be reliably effected regardless of the use of cartridges having a metal or plastic case. The movements of the ejector rod and of the chamber member can be matched in a simple manner because the telescopic ejector rod can be axially compressed. This will also prestress the ejector rod as the chamber member returns to its loading position, and the prestressed ejector rod will strike on the cartridge case as the ejector rod enters the chamber so that the cartridge case will be ejected without an obstruction.

Another embodiment of the invention relates to firearms in which the housing carries a magazine holder, which is adjacent to the chamber member when it is in its loading position and serves to receive and hold a magazine. In such an embodiment it is a feature of the invention that the slider is provided with a feeder on that side of the chamber member which is opposite to the ejector rod and that feeder is directed oppositely to the ejector rod and in an initial position overlaps the magazine holder, which is disposed behind the chamber member in the ejecting direction, whereas that feeder is retractable during the ejecting operation behind an ejecting opening, which is disposed behind the magazine holder. In that case a simple and inexpensive ejecting and loading structure will be provided because the ejector rod and the feeder constitute a functional unit and the forward movement performed by the slider after the ejecting operation can be utilized for the loading of the firearm. When the feeder has been displaced sufficiently to the rear for the ejecting operation and is subsequently advanced to its initial position, the feeder can push the next following cartridge from the magazine into the loading chamber so that the moving slider will not be used only to move the chamber member from its firing position to its loading position but the cartridge case can immediately be ejected from the chamber member and the latter can subsequently be reloaded without delay. The chamber member, the magazine holder and the ejecting opening are arranged one behind the other in the axial direction of the barrel so that the cartridge case can be ejected downwardly in a manner which will not disturb left-handed and right-handed operators.

DETAILED DESCRIPTION OF THE PREFERRED EMBODIMENT

Figure 1:
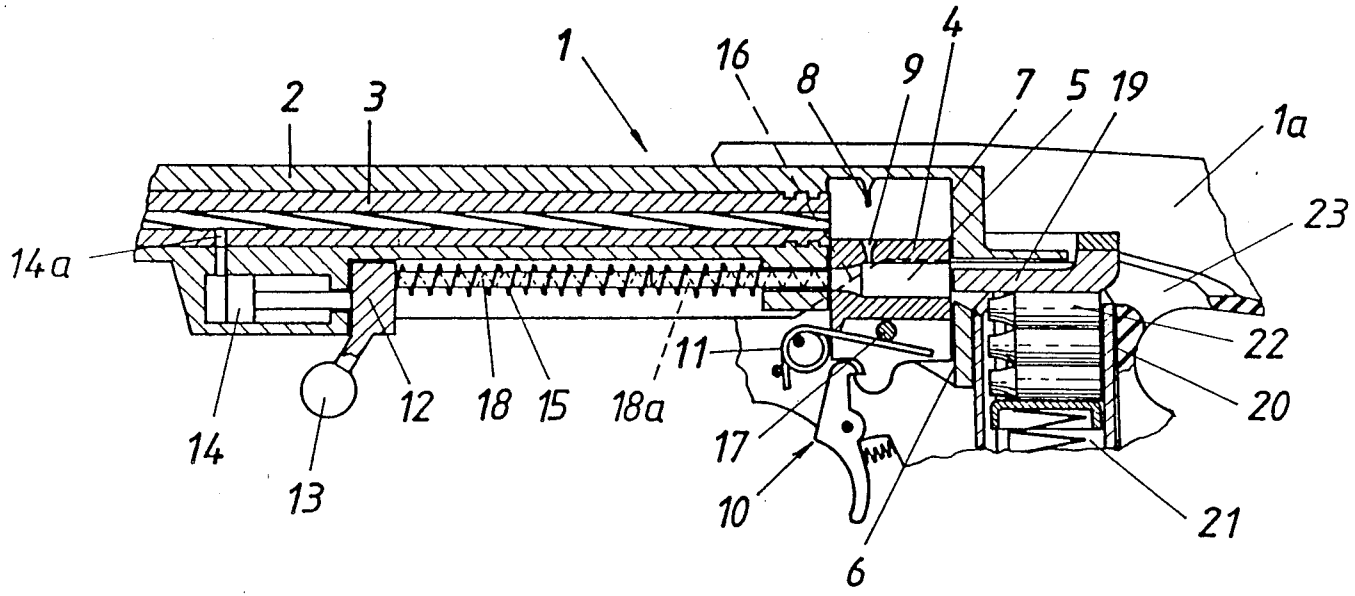
FIG. 1 is a longitudinal sectional view showing a firearm in one embodiment of the invention.

An illustrative embodiment of the invention will now be described more in detail with reference to the diagrammatic drawing.

A firearm 1 comprises a housing 2 and a barrel 3 and, as a separate component, a chamber member 4, which is separate from the barrel 3 and defines a chamber 5. The chamber member 4 is mounted in the housing 2 to be movable along a track 6 in a direction which is transverse to the barrel axis between an upper firing position for the discharge of a round and a lower loading position for ejecting the cartridge case and for loading the firearm. In the firing position the chamber 5 is coaxial to the bore of the barrel 3 and at one open end adjoins and communicates with said bore and at its other end is closed as tightly as possible by a fixed closing wall 7 of the housing 2. When the chamber member 4 is in its loading position, the chamber 5 is spaced from the barrel 3 and the closing wall 7 and is accessible at both ends. Because the chamber member 4 is transversely movable and defines the chamber 5, the kinetic energy of that chamber member 4 can be utilized to exert the firing force so that the firearm 1 has an entirely new mode of operation and the entire structure of the firearm can be substantially simplified, the firearm can be designed to have a more rugged structure, a maloperation of the firearm can be prevented, its overall length can be reduced and additional advantages can be afforded. For instance, the firearm is optimally usable to fire cartridges having plastic cases.

In the embodiment shown by way of example, the firing mechanism comprises a firing pin 8, which is fixed in the housing 2 and with which a radial firing bore 9 formed in the chamber member 4 is associated. As the chamber member 4 arrives in its firing position, the firing pin 8 enters the chamber 5 through the firing bore 9. In the loading position the chamber member 4 is releasbly held by a trigger 10 and a spring drive 11 is provided for moving the chamber member 4 from its loading position to its firing position.

The chamber member 4 is returned from its firing position to its loading position by means of a slider 12, which is mounted in the housing 2 in a suitable track for reciprocation in the axial direction of the barrel. By means of a grip 13 or a gas-operated actuator 14, the slider is moved rearwardly past the chamber member 4 against the force of a restoring spring 15. The slider is formed with cam faces 16 and the chamber member 4 is provided with cam followers 17. During the above-mentioned rearward movement of the slider 12, the cam faces 16 and the cam followers 17 cooperate to positively displace the chamber member 4 from its firing position to its loading position. The slider 12 carries also an ejector rod 18 and a feeder 19, which is directed opposite to the ejector rod 18. During the rearward and forward movements of the slider 12 the ejector rod 18 and the feeder 19 cooperate to eject the cartridge case from the chamber member 4 and to load the latter with a new cartridge.

Figure 2:
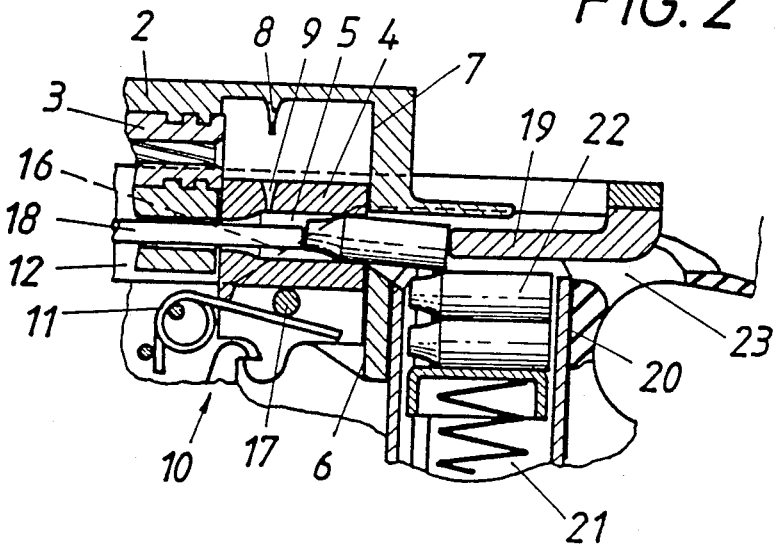
FIGS. 2 to 5 are sectional views which are similar to FIG. 1 and illustrate the firearm in different operating positions.

The firearm 1 is shown in FIG. 1 in a condition in which it is not loaded so that the chamber of the chamber member 4 is empty and the latter is locked by the trigger 10. In that initial position of the firearm 1 the slider 12 is in its forward end position and the chamber 5 extends coaxially between the ejector rod 18 and the feeder 19. In that initial position the feeder 19 extends over a magazine holder 20, into which a cartridge magazine 21 has been inserted. As is indicated in FIG. 2, the firearm 1 is loaded in that the slider 12 is pulled to the rear by means of the grip 13 so that the feeder 19 clears the magazine holder 20 and the uppermost cartridge 22 in the magazine 21 is raised into the path of the feeder 19. When the grip 12 has been released, the restoring spring 15 forces the slider 12 forwardly so that the cartridge 22 is pushed by the feeder 19 forwardly into the chamber 5. Now the firearm is loaded and ready to fire in the position shown in FIG. 3.

Figure 3:
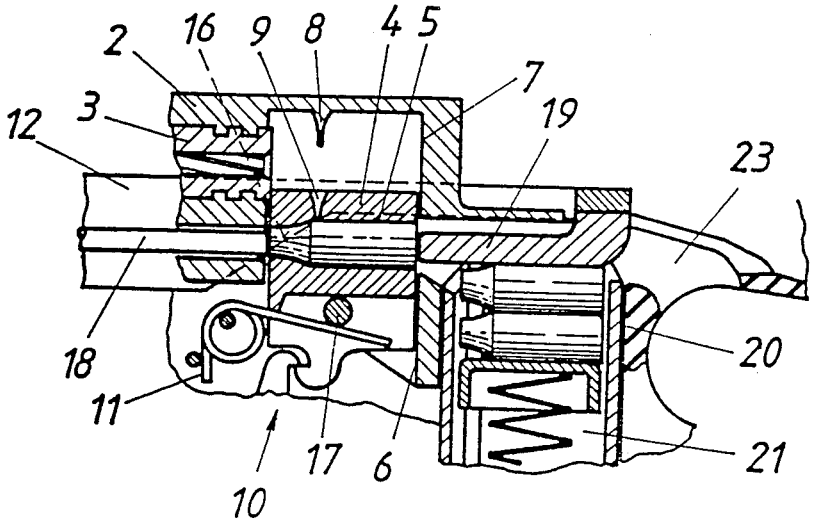
Figure 4:
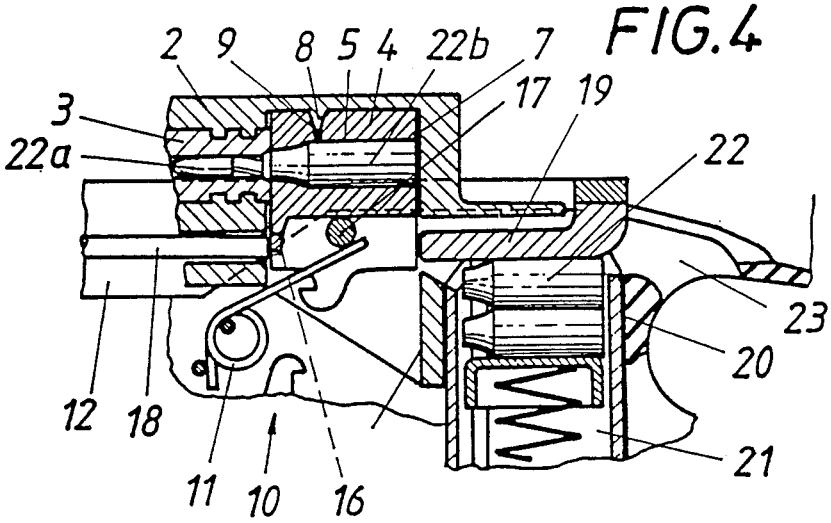
Figure 5:
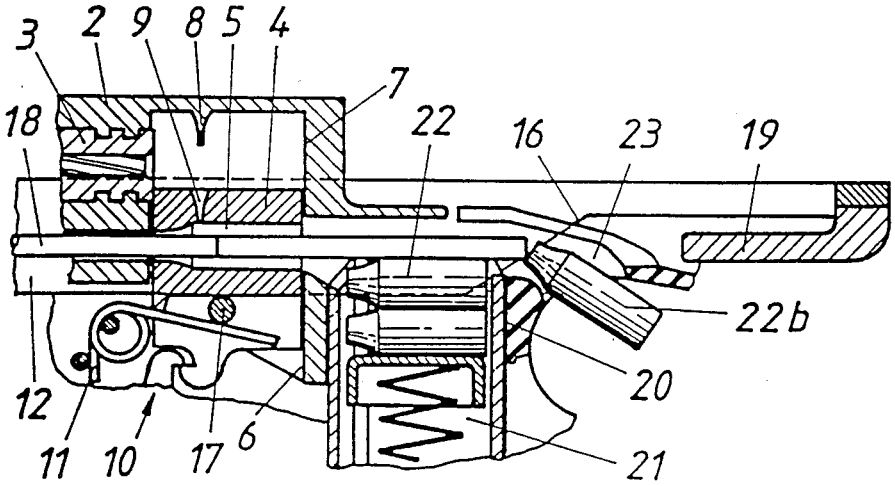

The trigger 10 can then be actuated to release the chamber member 4, which contains the cartridge 22. The spring drive 11 now forces the chamber member 4 from its loading position to its firing position at high speed so that the firing pin 8 enters the chamber 5 through the firing bore 9 and in the chamber 5 strikes on the rim primer, now shown, of the cartridge 22. As a result, the cartridge is automatically fired and the round is discharged, as is indicated in FIG. 4. The powder gases which are evolved propel the projectile **22*a* through the barrel 3 whereas the cartridge case 22*b* remains back in the chamber 5. The housing 2 and the barrel 3 are formed with a transverse bore 14*a*, which connects the bore of the barrel 3 to the gas-operated actuator 14. As soon as the projectile has moved beyond said transverse bore 14*a*, the powder gases flow from the barrel bore to the gas-operated actuator 14 so that the latter moves the slider 12 rearwardly against the force of the restoring spring 15. During that movement the cam faces 16 of the slider 12 engage the cam followers 17 of the chamber member 4 so that the latter and the empty cartridge case 22*b* contained therein are returned to the loading position, in which the chamber member 4 is then releasably locked by the spring-loaded trigger 10. The ejector rod 18 is telescopic and can be axially compressed against the force of an ejector spring 18a. During the return movement of the chamber member 4 the ejector rod 18 is axially compressed and is thus prestressed. When the chamber member 4 has reached its loading position, the chamber 5 is coaxial to the ejector rod 18 and the latter is suddenly extended by the ejector spring 18*a* to eject the cartridge case 22*b* from the chamber 5, as is shown in FIG. 5. The extending ejector rod 18 pushes the cartridge case 22*b* past the magazine 21 as far as to an ejecting opening 23, which is formed in the merely diagrammatically indicated stock 1*a* of the firearm 1. Because the feeder 19 is moved rearwardly in unison with the slider 12, the feeder 19 clears the path for the ejection of the cartridge case 22*b*. During the forward movement imparted to the slider 12 after the cartridge case 22 has been ejected, as is shown in FIGS. 2 and 3, the feeder 19 can immediately push the now uppermost cartridge 22 from the magazine into the chamber 5 in response to the forward movement of the slider 12** so that the firearm again assumes a condition in which it is loaded and ready to fire.

What is claimed is:

1. In a firearm comprising a housing, a barrel carried by said housing and having a barrel bore, which defines a barrel axis, a chamber member, which defines a chamber for containing a cartridge having a primer, and which is mounted in said housing for reciprocation relative to said barrel in a predetermined direction, which is transverse to said barrel axis, between predetermined loading and firing positions, wherein said chamber has forward and rear open ends, said forward end coaxially adjoins said barrel bore when said chamber is in said firing position, said housing comprises a closing wall axially facing said barrel bore and arranged to close said rear end of said chamber when said chamber member is in said firing position, and said forward and rear ends of said chamber are spaced from said barrel when said chamber member is in said loading position, and a firing mechanism, which is carried by said housing and operable to fire a cartridge contained in said chamber by an action on said primer of said cartridge when said chamber member is in said firing position, the improvement residing in that actuating means are provided for moving said chamber member from said loading position to said firing position so that said chamber member has a substantial kinetic energy as it arrives in said firing position, and said chamber member constitutes a part of said firing mechanism and is arranged to apply said kinetic energy to said primer so as to fire said cartridge as said chamber member arrives in said firing position.

2. The improvement set forth in claim 1 as applied to a firearm in which said firing mechanism comprises a firing pin for striking on the primer of a cartridge contained in said chamber so as to fire said cartridge when said chamber member is in said firing position, wherein said firing pin is arranged to strike on said primer so as to fire said cartridge in response to said kinetic energy as said chamber member arrives in said firing position.

3. The improvement set forth in claim 1, as applied to a firearm in which said firing mechanism comprises a firing pin, which is adapted to enter said chamber and to strike on said primer when said chamber member is in said firing position, wherein said chamber member is formed with a firing bore, which extends in said predetermined direction from the outside of said chamber member to said chamber, and said firing pin is fixed to said housing and is aligned with said firing bore in said predetermined direction and is arranged to enter said chamber through said firing bore and to strike on said primer as said chamber member arrives in said firing position.

4. The improvement set forth in claim 1 as applied to a firearm in which said firing mechanism comprises a spring-loaded trigger for releasably holding said chamber member in said loading position and in which spring said actuating means comprises means for moving said chamber member from said loading position to said firing position, wherein a slider is mounted on said housing for reciprocation in the direction of said barrel axis, restoring spring means are provided, which urge said slider forwardly relative to said housing to a forward end position, a gas-operable actuator is mounted on said housing and communicates with said barrel bore and comprises a piston-cylinder unit, which is operable by powder gases from said barrel bore to impart to said slider a rearward movement relative to said housing against the force of said restoring spring means, said slider has cam faces, which extend obliquely to said barrel axis and to said predetermined direction, said chamber member is provided on its outside with cam follower means, which are arranged to cooperate with said cam faces so as to move said chamber member to said loading position in response to said rearward movement of said slider.

5. The improvement set forth in claim 4, wherein said slider carries an axially compressible, telescopic ejector rod, which contains an ejector spring tending to extend said ejector rod and which extends parallel to said barrel axis and is disposed in front of said chamber member and has a free rear end, and said ejector rod is so arranged that when said chamber member is in its loading position said ejector rod is axially aligned with said chamber and is movable into said chamber by said rearward movement of said slider.

6. The improvement set forth in claim 5 as applied to a firearm in which said housing carries a magazine holder, which is adapted to receive a cartridge magazine and is arranged to be adjacent to said chamber member when the latter is in its loading position, and said firearm comprises means defining an ejecting opening which is disposed behind said magazine holder and arranged to communicate with said chamber when said chamber member is in said loading position, wherein said slider carries a feeder, which is disposed to the rear of said chamber member and has a free forward end that is axially aligned with said ejector rod and said feeder is arranged to extend over said magazine holder when said slider is in said forward end position and to move rearwardly past said ejecting opening in response to said rearward movement of said slider.

* * * * *